US005106332A

United States Patent [19]

Segan et al.

[11] Patent Number: 5,106,332

[45] Date of Patent: Apr. 21, 1992

[54] NOISE-MAKING DEVICE INCORPORATING "WHOOPING" PLATE

[75] Inventors: Marc H. Segan, New York, N.Y.; Steven M. Cohen, Hoboken, N.J.

[73] Assignee: M. H. Segan & Company, Inc., New York, N.Y.

[21] Appl. No.: 477,230

[22] Filed: Feb. 8, 1990

[51] Int. Cl.[5] ..... A63H 5/00

[52] U.S. Cl. ..... 446/415; 446/213; 446/421

[58] Field of Search ..... 446/213, 214, 215, 216, 446/188, 176, 397, 404, 405, 408, 415, 416, 417, 418, 421, 422, 486, 490, 491; 84/402, 402 R; 273/67 B; 119/29

[56] References Cited

U.S. PATENT DOCUMENTS

| | | | |
|---|---|---|---|
| 471,046 | 3/1892 | Wilskey | 446/421 |
| 1,026,256 | 5/1912 | Ehrman | 446/415 |
| 1,122,485 | 12/1914 | Donaldson | 446/213 |
| 1,206,933 | 12/1916 | Simonds et al. | 446/415 |
| 1,509,956 | 9/1924 | Kipp | 446/418 |
| 2,292,285 | 8/1942 | Ottofy | 446/415 X |
| 2,510,957 | 6/1950 | Carter | 84/402 |
| 2,687,059 | 8/1954 | Doyle | 84/402 |
| 2,898,704 | 8/1959 | Sattler | 446/213 |
| 3,871,653 | 3/1975 | Sambos | 273/67 B X |
| 3,902,272 | 9/1975 | Molenaar | 446/415 |
| 3,909,977 | 10/1975 | Kirk | 446/418 |
| 4,531,924 | 7/1985 | Samson | 446/213 |
| 4,787,876 | 11/1988 | Nguyen et al. | 446/418 X |
| 4,976,651 | 12/1990 | Frank | 446/421 |

FOREIGN PATENT DOCUMENTS

| | | | |
|---|---|---|---|
| 625881 | 8/1927 | France | 84/402 |
| 626408 | 10/1961 | Italy | 273/67 B |

*Primary Examiner*—David N. Muir

*Attorney, Agent, or Firm*—Schechter, Brucker & Pavane, P.C.

[57] ABSTRACT

An improved noise making device (10) particularly suited for use in stadiums, arenas and the like comprises a flexible, planar member of "whooping plate" (12), and a handle (14), both preferably comprised of plastic, the ends of the handle (14) being joined to the ends of the planar member (12) with the central section of the handle bowed outwardly from the planar member, such that when the handle is gripped and thrust forward and backward, the planar member bows inwardly and outwardly, thereby generating a loud noise. Suitable indicia, such as a team logo or advertising message, may be imprinted on the outer surface of the planar member.

27 Claims, 2 Drawing Sheets

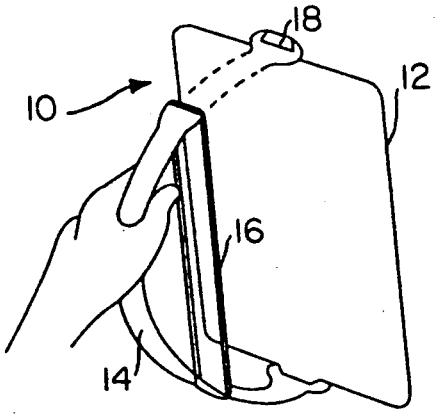
FIG. 1A
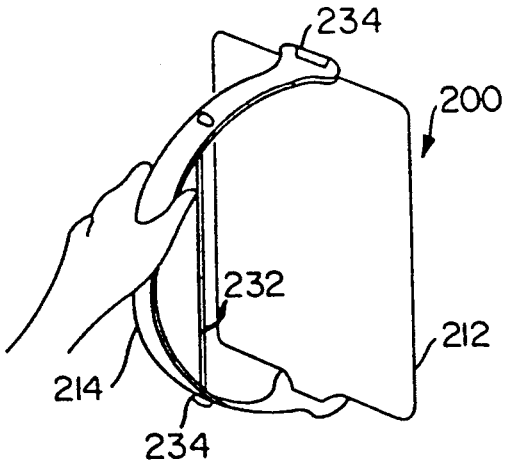
FIG. 1B
FIG. 2
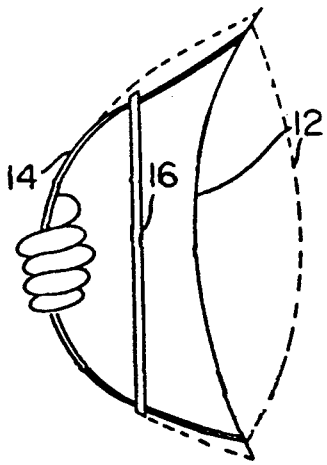
FIG. 3
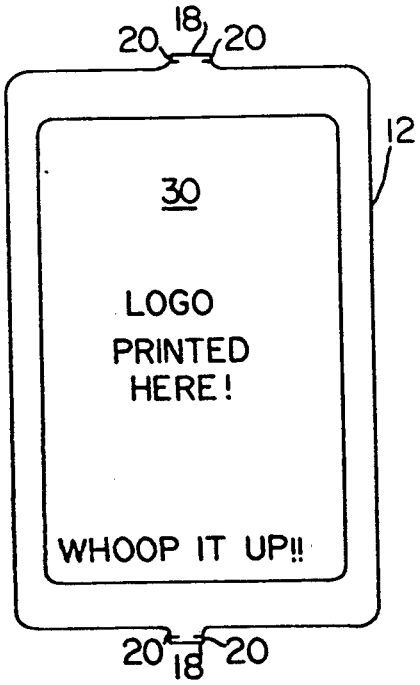

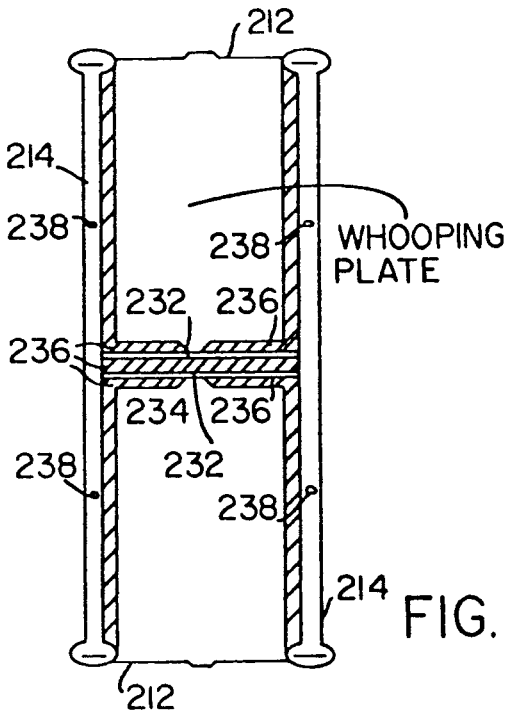
FIG. 4
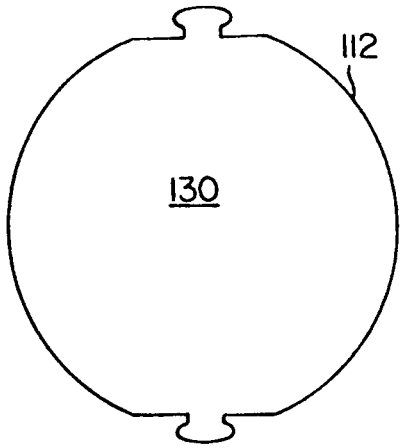
FIG. 6
FIG. 5
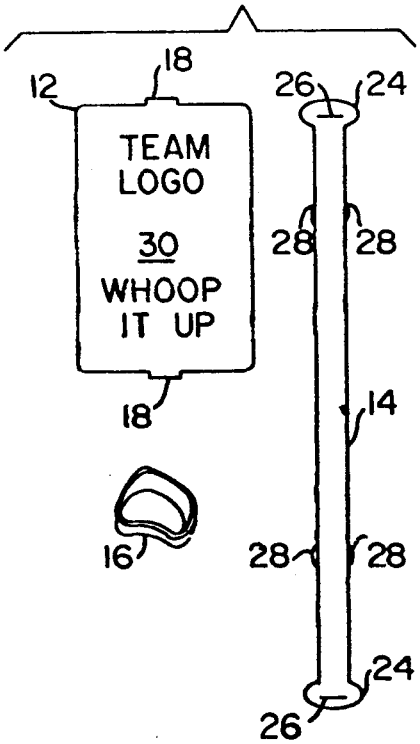
FIG. 7
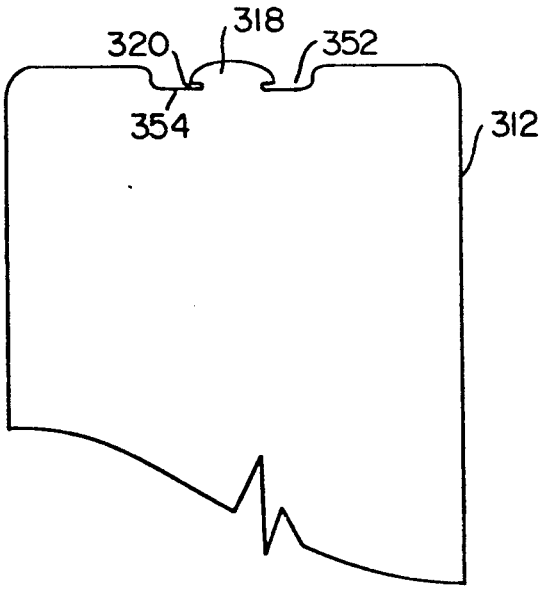

NOISE-MAKING DEVICE INCORPORATING "WHOOPING" PLATE

BACKGROUND OF THE INVENTION

1. Field of the Invention

This invention pertains to noise making devices, and particularly to noise making devices for use in stadiums, arenas, etc.

2. Prior Art

Sporting events held in stadiums, arenas, etc. are usually well attended. Nevertheless, fan participation in the event is limited, usually being confined to cheering for the home team, typically by clapping, yelling, stamping the feet, etc. or, more recently, with the controversial "wave". Sometimes, fan cheering is augmented by devices sold or given away at the site, e.g. fans have twirled hand towels, waved foam fingers in the "number one" configuration, etc. Some fans even come to the event with their own devices, such as horns, multiple placards bearing various messages, oversized beach balls for bouncing among the fans, to name a few.

Considering the number of fans attending sporting events annually and the rather limited means for fan participation as summarized above, it is perceived that there is a need for additional fan participation devices, and particularly devices for generating noise for expressing fan appreciation. Moreover, it would be highly advantageous if such devices could serve as an advertising medium for promoting the home team or even the products/services of an independent sponsor.

It is accordingly an object of the invention to provide an improved noise making device particularly suited for use by fans attending sporting events at stadiums, arenas, etc.

It is a further object of the invention to provide an improved noise making device which is also usable as an advertising medium.

It is yet an additional object of the invention to provide an improved noise making device of the type described which is sufficiently inexpensive that large numbers of fans can be expected to purchase it or, alternatively, that it may even be given away as a promotion.

SUMMARY OF THE INVENTION

Broadly speaking, the present invention is a noise making device comprising a flexible planar member, and a handle having its two ends joined to the flexible planar member in spaced relation from each other and having a central section bowed outwardly from the planar member to facilitate gripping of the handle, such that thrusting the handle forward and backward causes the planar member to flex outwardly and inwardly, thereby generating noise. In a preferred embodiment, the planar member is inwardly tensioned by pinching the legs of the handle together, as with a rubber band or tensioning strip, as this has been found to increase the level of noise generated by the device of the invention. As the planar member, handle and, where used, the tensioning strip are all preferably comprised of plastic, the device is inexpensive to make and, when these components are of the same thickness, they may be die cut from a single sheet of plastic. Furthermore, the outer surface of the planar member provides an ideal advertising medium, e.g for imprinting a team logo, sponsor advertisement, etc.

The present invention also comprises a kit for a noise making device comprising a flexible planar member, a handle having two ends and a central section therebetween, and a means for securing the ends of the handle to the flexible planar member in spaced relation from each other and with the central section of the handle bowed outwardly from the planar member to facilitate gripping of the handle, whereby gripping the handle and thrusting it forward and backward causes the planar member to flex outwardly and inwardly thereby generating noise. It is also significant that the thrusting motion which activates the device of the invention is similar to the fist shaking motion used by many fans at sporting events to express satisfaction. In other words, use of the device affords fans two independent but simultaneous forms of expressing their satisfaction—fist shaking and noise generation.

The invention also comprises a method for making noise comprising providing a substantially rigid planar member, fixing the planar member in two spaced locations, and agitating the planar member to cause the portion thereof between said two spaced locations to repeatedly flex inwardly and outwardly for generating noise.

These as well as further features and advantages of the present invention will be more fully apparent from the following detailed description and annexed drawings of the presently preferred embodiments thereof.

BRIEF DESCRIPTION OF THE DRAWINGS

In the drawings, wherein like numerals represent like parts:

FIG. 1A is a perspective view of the noise making device in accordance with the present invention;

FIG. 1B is a view similar to FIG. 1A but showing an alternative tensioning element;

FIG. 2 is a side view of the noise making device of FIG. 1A, showing the motion of the whooping plate;

FIG. 3 is a front view of the whooping plate incorporated in the noise making device of FIG. 1A;

FIG. 4 is a plan view of a rectangular planar plastic member showing a die cut pattern suitable for two noise making devices in accordance with the invention;

FIG. 5 is a plan view showing the component parts of the noise making device of FIG. 1A;

FIG. 6 is a front view of an alternative shape for a whooping plate in accordance with the present invention; and FIG. 7 is a partial view similar to FIG. 3 but showing an alternative arrangement for attaching the handle to the whooping plate;

DETAILED DESCRIPTION OF THE PREFERRED EMBODIMENTS

Referring now to the drawings, and initially to FIG. 1A thereof, the presently most preferred noise making device in accordance with the present invention is generally designated at 10. As shown, the device 10 includes a planar member 22, a handle 14 and a tensioning element 16 which, in FIG. 1A, is a rubber band. Hereinafter the planar member 12 is sometimes referred to as a "whooping plate" because of the sound it produces when the device 10 is in use.

Referring to FIGS. 1A, 3 and 5, the whooping plate 12 is of rectangular configuration and is formed with tabs 18 at either end thereof, each tab 18 having a pair of slits 20 extending inwardly from either side thereof. Presently preferred dimensions for the whooping plate 12 are 8.25" by 12.0", with a thickness of 0.040", though the actual size, shape and thickness are, to some extent, a matter of choice, though rectangular shapes from about 6.0" by about 4.0" to about 18" are presently preferred, as are plate thicknesses from about 0.020" to about 0.20". The handle 14 is formed as an elongate strip of plastic having an enlarged head 24 at either end, each head 24 having a slot 26 therein. As shown, the strip 14 is formed with two spaced pairs of protrusions or nibs 28 extending outwardly from the sides thereof. Presently preferred dimensions for the strip 14 are 23.0" long (22.0" from one slot 26 to the other) and 1.0" wide, with a thickness of 0.10" thick. The planar member 12 and the handle 14 are preferably made of plastic, and particularly polystyrene. Biodegradable materials, such as polyesters, may also be employed.

The device 10 is assembled from the components shown in FIG. 5 by first forcing the slots 26 at either end of handle 14 over tabs 18 at either end of the whooping plate 12 until the defining walls of the slots 26 seat in the slits 20, thereby firmly joining the handle 14 to the whooping plate 12. Because the length of handle 14 is greater than the length of whooping plate 12, when the handle is secured to the whooping plate it assumes the bowed configuration shown in FIG. 1A. Assembly is completed by simply stretching the rubber band over the handle 14 in the manner shown in FIG. 1A, wherein it may be seen that the nibs 28 prevent the rubber band 16 from slipping off the handle. The noise making device 10 is now ready for use.

To use the device 10, the user grips the handle 14 with one hand in the manner shown in FIG. 2, and then rapidly and repeatedly moves the handle forwards and backwards. As illustrated by the solid and dotted lines in FIG. 2, repeated thrusting of the handle 14 causes the whooping plate 12 to alternately flex inwardly and outwardly. The resulting air movement creates a high pitched and unexpectedly loud "whooping" sound ideal for relating fan appreciation. Moreover, the thrusting motion which activates the device 10 is similar to the fist shaking motion widely used by fans to express their appreciation, whereby use of the device 10 affords the user two forms of expression—fist shaking and noise making. While each noise making device 10 generates significant noise, if even several hundred devices 10 are put into action at the same time, such as after the home team scores a touchdown, run, basket, goal, etc., the noise level will be substantial. The sound generated by several thousand will be enormous.

Several factors contribute to a determination of the noise produced by the device 10. In particular, the level of noise produced by the device 10 is determined by the surface area of the whooping plate 12 and its thickness, as well as by the inward tension applied at the ends of the plate 12 by the handle 14. Of course, although generally speaking changing the size, thickness and/or shape of the plate 12 changes the noise level and/or timbre generated with each thrust, selection of an appropriate size and thickness for the plate 12 represents a compromise dictated by the intended use of the device 10, i.e. if the plate is too large it will be too cumbersome, and if too thick, it will be too hard to set in motion. Regarding the inward tension on the plate 12, it is believed that increasing the inward tension on the plate increases the force required to move the plate through its planar, equilibrium configuration to its inward or outwardly bowed configuration. This, in turn, increases the energy transmitted to the plate 12 with each forward and backward thrust, and hence the level of noise generated by movement of the plate. While the handle 14 may apply some inward tension to the plate 12 and the device 10 could be used without the rubber band 16, use of the rubber band adds significantly to the inward tension and hence to the noise level generated by the device 10. Once again, however, selection of an appropriate level of inward tension is a compromise dictated by intended use, i.e. if the inward tension is set too high, the plate 12 will be too hard to set in motion or the plate will bow in its rest state which, primarily for aesthetic reasons, is preferably avoided. It should also now be apparent that the "play" in the joints connecting the whooping plate 12 and the handle 14 should be minimized such that substantially all of the force imparted to the handle by the user is converted to inward and outward movement of the plate. It has been found that the presently preferred method of joining described hereinabove is sufficient for this purpose. It will also be apparent from the foregoing that the whooping plate 12 should be substantially rigid, i.e. rigid enough to retain its shape and structural integrity despite the tension applied by the handle 14 and the rubber band 16, yet flexible enough to bow inwardly and outwardly for generating noise as the handle 14 is thrust backward and forward.

In addition to its noise generating function, the whooping plate 12 can also serve an important advertising or message function. That is, since the whooping plate is a planar rectangular member whose front surface 30 is in full view during use, the surface 30 may be used for displaying any suitable indicia. For example, and as shown in FIGS. 3 and 5, a team logo may be displayed along with an appropriate message, such "WHOOP IT UP". Alternatively, or additionally, a third party sponsor could display its logo on the surface 30, representing a potential source of revenue for the proprietor. Since the noise level produced by the whooping plate 12 appears to be largely dependent on its thickness, indicia are preferably formed on the surface 30 in a manner which adds little, if any, thickness to the whooping plate, e.g. printing, silk screening, or offset printing. As a further alternative, the surface 30 may be formed as a dry erase board whereby the user could write his/her own erasable messages using an appropriate marker. Of course, it will by now be apparent that the plate 12 may be formed in other than a rectangular configuration, and indeed the shape of the plate may contribute to its message function. For example, the outer surface 130 of the round whooping plate 112 of FIG. 6 could be imprinted to simulate a baseball, basketball, soccer ball, hockey puck, etc. Alternatively, the shape of the whooping plate could be selected to simulate some aspect of the home team logo. In any event, it will be apparent that the noise making device 10, and particularly the outer surface of the whooping plate, can serve a powerful advertising function.

FIG. 1B shows a modified noise making device 200 in accordance with the present invention. The device 200 is identical to the device 10 of FIG. 1A, except that the rubber band 16 has been replace by a plastic tensioning strip 232. The plastic tensioning strip 232, which is also preferably comprised of polystyrene, is substantially shorter than the handle 214, the precise length of the strip 232 being selected to increase the inward tension on the whooping plate 212 without, however, bowing the plate in its rest state or making it too difficult to set the plate in motion. Use of the strip 232 may actually be preferable to the rubber band 16, as the strip 232 adds an overall stability to the device 200 and seems to result in an increase in the noise level which is greater than the increase occasioned by use of a rubber band.

While a variety of ways for securing the tensioning strip 232 to the handle 214 will suggest themselves to those of ordinary skill in the art, the method shown in FIG. 1A is presently preferred. That is, and referring now to FIGS. 1A and 4, the ends of the tensioning strip 232 are preferably formed with tabs 234 at either end, each tab having a pair of inwardly extending slits 236, much like the slits 20 in the tabs 18 (see FIG. 3). The handle 214, in turn, is formed with two spaced slots 238, such that the tensioning strip 232 may be secured to the handle 214 by forcing the tabs 234 through the slots 238 until the defining walls of the slots 238 seat in the slits in tabs 234. Assembly of the noise making device 200 of FIG. 1B is otherwise identical to that of the device 10 of FIG. 1A. Assuming the dimensions of the whooping plate 212 and the handle 214 of the noise making device 200 are as given above for the device 10, the tensioning strip 232 may be 9.625" long, 1.25" wide, and 0.080" thick.

Presently, and as noted above in connection with the most preferred noise making device 10, the thickness of the whooping plate 12 is less than the thickness of the handle 14. In this regard, if the handle is too thin it becomes so flexible that thrusting the handle back and forth causes substantial flexing of the handle, but little movement of the whooping plate 12, and hence little noise. In this embodiment, therefore, it is contemplated that the whooping plate 12 and handle 14 will be separately formed from plastic sheets of different thicknesses and then packaged together along with a rubber band 16. However, there are embodiments wherein the thicknesses of the whooping plate, handle and, where employed, the tensioning strip, will all be the same. In the case of such embodiments, all of the component parts may be die cut form a single plastic sheet. For example, the plastic sheet 250 shown in FIG. 4 illustrates a die cut pattern suitable for forming two noise making devices 200 of the type shown in FIG. 1B, wherein each of the whooping plate 212, handle 214 and tensioning strip 232 are 0.050" thick. It will be apparent that the pattern shown in FIG. 4 results in very little wasted plastic, which is represented by the shaded areas. By the appropriate use of score lines, the sheet 250 may be separated into two parts, each having a whooping plate 212, a handle 214 and a tensioning strip 232. Each part could then be packaged as is, with the user separating the component parts from each other upon opening the package, again with the aid of appropriate score lines.

FIG. 7 shows a modified whooping plate 312 which is similar to those of FIGS. 1A and 1B save for the manner in which the tabs 318 are formed. In particular, rather than protruding from the ends of the plate 312, the tabs 318 are formed in recesses 352 at either end of the plate 312, with the slits 320 being defined by spaces between the tabs 318 and the bottom defining walls 354 of the recesses 352.

While we have herein shown and described the preferred embodiments of the noise making device in accordance with the present invention and suggested various modifications thereto, still further changes and modifications will suggest themselves to those of ordinary skill in the art. For example, each whooping plate could be formed with one or more small holes whereby once the sporting event is over, the user may disassemble the device and hang the whooping plate on a vertical surface, such as a wall or door, whereby the user may display the team logo or other imprinted message in his home, office, etc. Yet another possibility is to provide a fastener with each noise making device such that the handle may be formed into a hoop and attached to the whooping plate for simulating a basketball hoop and backboard, which opens the further possibility of including a string net and Nerf TM ball with each noise making device. A still further possibility is to form the whooping plate with a plurality of frangible sections defined by score lines such that the dimensions of the whooping plate may be varied by breaking off one or more sections, whereby to vary the pitch of the sound produced by the noise making device. Since these as well as still further changes and modifications are intended to be within the scope of the present invention, the above description should be construed as illustrative and not in a limiting sense, the scope of the invention being defined by the following claims.

We claim:

1. A noise-making device comprising:

a member defining a flexible, planar section; and a handle having a pair of ends and a gripping section therebetween, the ends of said handles being joined to said member in spaced apart relation at opposite ends of said planar section, said ends of said handle being joined to said member, and said planar section having sufficient flexibility and rigidity, for accommodating repeated inward and outward flexing of said planar section upon repeated thrusting of said gripping section back and forth, said repeated inward and outward flexing of said planar section generating a repetitive noise having a discernable tonal quality.

2. The device of claim 1, wherein said member comprises a planar member, and wherein said planar section comprises a portion of said planar member.

3. The noise-making device of claim 1, wherein the central portion of the handle is bowed outwardly from the member, said central portion defining said gripping section.

4. The noise making device of claim 1, wherein the planar member is comprised of plastic.

5. The noise making device of claim 4, wherein the outer surface of the planar member has indicia imprinted thereon.

6. The noise-making device of claim 1, wherein said member comprises said planar section.

7. The noise making device of claim 6, wherein the planar section and the handle are comprised of plastic.

8. The noise making device of claim 7, further comprising means for securing the ends of the handle to the planar section.

9. The noise making device of claim 8, wherein said securing means comprises tabs formed on the ends of the planar section and slots formed in the ends of said handle, with the tabs dimensioned for a force fit through the slots, whereby the ends of the handle are releasably secured to the ends of the planar section.

10. The noise making device of claim 9, further comprising slits on either side of said tabs for receiving the defining walls of the slots.

11. The noise making device of claim 3, further comprising a means for inwardly compressing the planar section.

12. The noise making device of claim 11, wherein said means for inwardly compressing the planar section comprises an elastic band disposed about said gripping section of said handle between the ends thereof.

13. The noise making device of claim 11, wherein said means for inwardly compressing said planar section comprises a planar strip joined at one end to one leg of the central section of the handle and at the other end to the other leg of the central section of the handle.

14. The noise making device of claim 13, further comprising means for releasably securing the ends of the planar strip to the handle.

15. The noise making device of claim 7, wherein said planar section and said handle are comprised of polystyrene, said handle is about 0.1 inches thick and said planar section is about 0.04 inches thick.

16. The noise making device of claim 6, further comprising a means for inwardly compressing the planar section.

17. The noise making device of claim 16, wherein said means for inwardly compressing the planar section comprises an elastic band disposed about said gripping section of said handle between the ends thereof.

18. The noise making device of claim 16, wherein said means for inwardly compressing said planar section comprises a planar strip joined at one end to one leg of the central section of the handle and at the other end to the other leg of the central section of the handle.

19. The noise making device of claim 18, further comprising means for releasably securing the ends of the planar strip to the handle.

20. The noise making device of claim 16, wherein said planar section and said handle are comprised of polystyrene, said handle is about 0.1 inches thick and said planar section is about 0.04 inches thick.

21. The noise making device of claim 15, wherein said planar section is substantially rectangular and is from about 6.0" by about 4.0" to about 24.0" by about 18.0".

22. The noise making device of claim 16, wherein the outer surface of the planar section has indicia imprinted thereon.

23. The noise making device of claim 20, wherein said planar section is substantially rectangular and is from about 6.0" by about 4.0" to about 24.0" by about 18.0".

24. A method of generating a repetitive noise having a discernable tonal quality, comprising:

a providing a member defining a flexible, planar section;

providing a handle having a pair of ends and a gripping section therebetween, the ends of the handles being joined to the member in spaced apart relation at opposite ends of the planar section; and gripping said gripping section of said handle and repeatedly thrusting same back and forth, said ends of said handle being joined to said member, and said planar section having sufficient flexibility and rigidity, such that repeated back and forth thrusting of said gripping section effects repeated inward and outward flexing of said planar section, said repeated inward and outward flexing of said planar section generating said repetitive noise having a discernable tonal quality.

25. The method of claim 24, further comprising the step of inwardly compressing said planar section.

26. The method of claim 25, wherein said step of providing a handle comprises providing a flexible handle having its ends joined to said member with said gripping section bowed outwardly therefrom, and wherein said step of inwardly compressing said planar section comprises squeezing together the legs of said handle on either side of said gripping section.

27. The method of claim 24, further comprising the step of imprinting indicia on the outer surface of said member.

* * * * *

UNITED STATES PATENT AND TRADEMARK OFFICE

CERTIFICATE OF CORRECTION

PATENT NO. : 5,106,332

DATED : April 21, 1992

INVENTOR(S) : Segan et al.

It is certified that error appears in the above-identified patent and that said Letters Patent is hereby corrected as shown below:

Column 2, line 59, change "22" to --12--.

Column 3, line 4, before "18"" insert --24" by about--.

Column 4, line 34, after "such" insert --as--.

Column 5, line 39, change "form" to --from--.

IN THE CLAIMS:

Claim 24, line 12, before "providing" delete --a--.

Signed and Sealed this

Fifth Day of October, 1993

*Attest:*

*Attesting Officer*

BRUCE LEHMAN

*Commissioner of Patents and Trademarks*